US008757753B2

(12) United States Patent
Suzuki et al.

(10) Patent No.: US 8,757,753 B2
(45) Date of Patent: Jun. 24, 2014

(54) PRINTING APPARATUS AND PRINTING METHOD

(75) Inventors: Kazuo Suzuki, Yokohama (JP); Kazuhiko Sato, Tokyo (JP); Taku Yokozawa, Yokohama (JP); Yosuke Ishii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 507 days.

(21) Appl. No.: 12/633,291

(22) Filed: Dec. 8, 2009

(65) Prior Publication Data

US 2010/0156973 A1 Jun. 24, 2010

(30) Foreign Application Priority Data

Dec. 19, 2008 (JP) ..... 2008-324129

(51) Int. Cl.
*B41J 29/38* (2006.01)

(52) U.S. Cl.
USPC ..... 347/12; 347/9; 347/96

(58) Field of Classification Search
None
See application file for complete search history.

(56) References Cited

U.S. PATENT DOCUMENTS

| | | | | |
|---|---|---|---|---|
| 5,909,229 | A | 6/1999 | Moriguchi et al. | |
| 6,164,773 | A | 12/2000 | Oikawa | |
| 6,264,320 | B1 * | 7/2001 | Moriyama et al. | 347/101 |
| 6,991,327 | B2 | 1/2006 | Goto et al. | |
| 7,967,411 | B2 | 6/2011 | Nitta et al. | |
| 2003/0117453 | A1 | 6/2003 | Goto et al. | |
| 2009/0109258 | A1 | 4/2009 | Nitta et al. | |

FOREIGN PATENT DOCUMENTS

| | | | |
|---|---|---|---|
| JP | H03227644 | A | 10/1991 |
| JP | 8-007223 | A | 1/1996 |
| JP | 8-281931 | A | 10/1996 |
| JP | H1076639 | A | 3/1998 |
| JP | 2003-25563 | A | 1/2003 |
| JP | 2008-296522 | A | 12/2008 |

OTHER PUBLICATIONS

Japanese Office Action issued in counterpart application No. 2009-279649 dated Sep. 24, 2013, along with its English-language translation—4 pages.

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

The present invention has an object to provide an inkjet printing apparatus that can realize both high quality image formation and improvement of a device life caused by the reduction of a mist amount of a processing liquid. The present invention is provided with a control unit that can independently control an ink ejection condition in an ink ejection unit and a processing-liquid ejection condition in a processing-liquid ejection unit. The control unit controls the ejection condition in each ejection unit so that the mist amount of the processing liquid ejected from the processing-liquid eject unit is smaller than that of the ink ejected from the ink eject unit.

9 Claims, 11 Drawing Sheets

| BLOCK NO. | | | |
|---|---|---|---|
| DRIVING ORDER | DRIVING ORDER A | DRIVING ORDER B | DRIVING ORDER C |
| 1 | 0 | 0 | 0 |
| 2 | 10 | 8 | 1 |
| 3 | 1 | 4 | 2 |
| 4 | 11 | 12 | 3 |
| 5 | 2 | 16 | 4 |
| 6 | 12 | 2 | 5 |
| 7 | 3 | 10 | 6 |
| 8 | 13 | 6 | 7 |
| 9 | 4 | 14 | 8 |
| 10 | 14 | 18 | 9 |
| 11 | 5 | 1 | 10 |
| 12 | 15 | 9 | 11 |
| 13 | 6 | 5 | 12 |
| 14 | 16 | 13 | 13 |
| 15 | 7 | 17 | 14 |
| 16 | 17 | 3 | 15 |
| 17 | 8 | 11 | 16 |
| 18 | 18 | 7 | 17 |
| 19 | 9 | 15 | 18 |
| 20 | 19 | 19 | 19 |

FIG.8

PRINTING APPARATUS AND PRINTING METHOD

BACKGROUND OF THE INVENTION

1. Field of the Invention

The present invention relates to a printing apparatus that performs printing by using a processing liquid which coagulates or insolubilizes a coloring material in ink or ink and to a printing method.

2. Description of the Related Art

In general inkjet printing apparatus, if an image is formed on a print medium called so-called plain paper, water resistance of the image may be insufficient, and solution to that is required. In the meantime, in the case of printing using a relatively large amount of ink to be applied to the print medium such as formation of a color image, feathering or bleeding between colors can easily occur, and formation of a clear image with high density and suppressing these phenomena is also in demand. However, it is difficult to satisfy both the above requirements, and a color image provided with sufficient image fastness and image quality has not been realized yet.

As a method for improving water resistance of an image, ink with a coloring material contained therein having water resistance has been put into practice recently. However, the current ink with improved water resistance is ink that is hardly dissolved in water after being dried in principle, the ink can easily clog a nozzle of a print head, and its water resistance is not necessarily sufficient.

Thus, the improvement of an apparatus by providing a new mechanism improving water resistance and preventing nozzle clogging has been proposed. However, in this case, there is a problem in that the device is complicated and the apparatus cost is drastically increased.

On the other hand, Japanese Patent Laid-Open No. H08-007223 (1996) discloses a technique that improves fastness of an image printed by ink by providing a processing liquid such as a print property improving liquid which causes chemical reaction with printing ink at the same position as a position to provide the ink onto the print medium.

However, in the inkjet printing apparatus, when the ink and the processing liquid is ejected from a print head, micro mist-state droplets other than main droplets landing on the print medium are generated. If these micro ink droplets and processing liquid droplets adhere to an operation portion inside the printing apparatus or a surface in which a ejection port of the print head is formed (hereinafter referred to as a ejection port surface), they react with each other and are firmly fixed at an adhesion portion and deteriorate reliability and life of the apparatus, which is a problem. Therefore, it is necessary to suppress reaction and fixation between the ink and the processing liquid other than on the print medium, and for that purpose, it is necessary to drastically reduce the generation of the micro droplets of the processing liquid (processing-liquid mist). Also, the lower the ink ejection speed is, the smaller the amount of the processing-liquid mist is, and the smaller the ejection amount is, the smaller the mist amount is. Therefore, the reduction of the processing-liquid mist by suppressing the ink ejection speed or the ejection amount is also discussed.

However, there arise a new problem that if the ejection speeds and the ejection amounts of the ink and the processing liquid are reduced in order to reduce the processing-liquid mist, the landing accuracy of the ink is lowered and image quality is deteriorated.

SUMMARY OF THE INVENTION

The present invention was made in view of the above problems and has an object to provide an inkjet printing apparatus that can realize both high-quality image formation and life improvement of an apparatus by reducing the mist amount of a processing liquid.

In order to achieve the above object, the present invention has the following configuration.

That is, a first aspect of the present invention is an inkjet printing apparatus that performs printing by driving an ink ejecting unit ejecting ink containing a coloring material and a processing liquid ejecting unit that can eject processing liquid not containing the coloring material and capable of condensing the coloring material in the ink, provided with a controller controlling a ejection condition of the ink by the ink ejecting unit and a ejection condition of the processing liquid by the processing liquid ejecting unit, independently, the controller controlling the ejection conditions of the ejecting units so that the mist amount of the processing liquid ejected from the processing liquid ejecting unit is smaller than that of the ink ejected from the ink ejecting unit.

A second aspect of the present invention is a printing apparatus comprising: a driving unit that drives a first printing element array and a second printing element array by applying a driving signal to the first printing element array that ejects ink containing a coloring material and the second printing element array that ejects processing liquid not containing a coloring material, the processing liquid coagulating or insolubilizing a coloring material in the ink, wherein the driving unit applies to the first printing element array the driving signal generating ejection energy larger than the ejection energy applied to the second printing element array.

A third aspect of the present invention is a printing apparatus comprising: a printing unit performing printing by using a first printing element array that ejects ink containing a coloring material and a second printing element array that ejects processing liquid not containing a coloring material, the processing liquid coagulating or insolubilizing a coloring material in the ink; and a controller controlling a temperature when ink is ejected by driving the first printing element array and the second printing element array, wherein the controller controls a temperature of the ink ejection unit to a temperature higher than that of the processing liquid eject unit.

A fourth aspect of the present invention is a printing apparatus comprising: a printing unit performing printing by using a first printing element array that ejects a first ink and a second printing element array that ejects a second ink, the second ink having a printing density per droplet that is lower than that of the first ink and reacting with the first ink; and a driving unit that drives the first printing element array so that discrete printing elements are sequentially driven and drives the second printing element array so that the adjacent printing elements are sequentially driven.

A fifth aspect of the present invention is a printing method comprising the steps of: performing printing by using a first printing element array that ejects ink containing a coloring material and a second printing element array that ejects processing liquid not containing a coloring material, the processing liquid coagulating or insolubilizing a coloring material in the ink; and driving the first printing element array so that the discrete printing elements are sequentially driven, and the second printing element array so that the adjacent printing elements are sequentially driven.

According to the present invention, since the mist amount of a processing liquid can be reduced without lowering the ejection amount and the ejection speed of ink droplets, the high-quality image formation and the improvement of an apparatus life can be both realized.

Further features of the present invention will become apparent from the following description of exemplary embodiments (with reference to the attached drawings).

BRIEF DESCRIPTION OF THE DRAWINGS

FIG. 8 is a schematic diagram illustrating a driving order of plurality of time-division driving in the first embodiment;

DESCRIPTION OF THE EMBODIMENTS

First Embodiment

Figure 1:
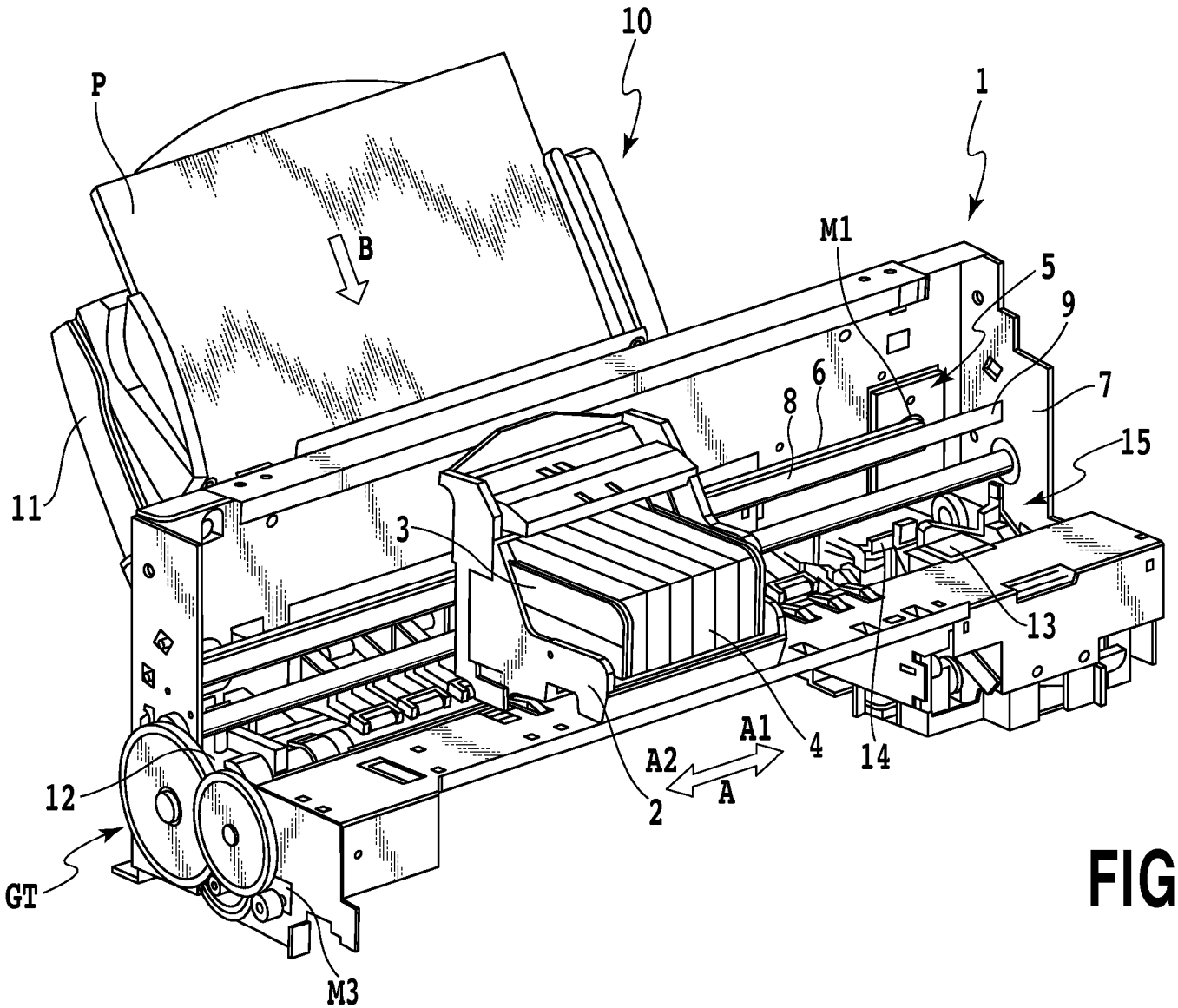
FIG. 1 is a perspective view illustrating an inkjet printing apparatus in a first embodiment of the present invention.

FIG. 1 is a perspective view illustrating an inkjet printing apparatus according to a first embodiment of the present invention.

An inkjet printing apparatus 1 shown here is provided with a carriage 2 that can perform reciprocal scanning along a main scanning direction shown by an array A. On the carriage 2, a print head 3 as a printing unit that can eject ink is detachably mounted. Also, an inkjet cartridge 4 housing ink and supplying the ink to the print head 3 is detachably held by the print head 3.

Figure 2:
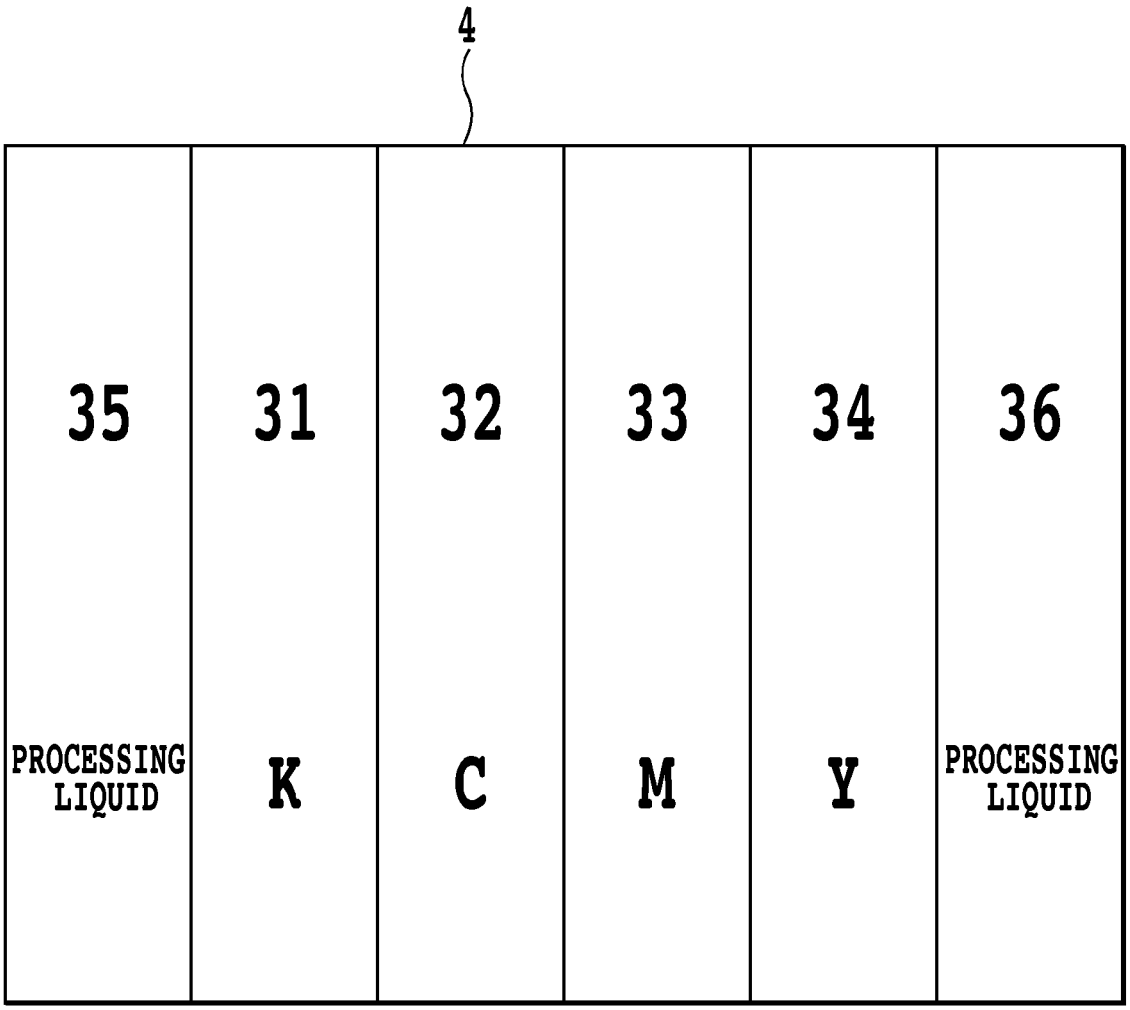
FIG. 2 is a schematic diagram illustrating a configuration of an ink cartridge mounted on the inkjet printing apparatus shown in FIG. 1.

In the inkjet cartridge 4, black (K) ink and color ink of cyan (C), magenta (M), and yellow (Y) and a processing liquid that can coagulate the coloring material in the ink and not containing a coloring material are contained, respectively. The processing liquid is arranged one each at both ends of the ink cartridge 4. This is shown in FIG. 2. The processing liquid is arranged on the both ends so that the processing liquid is ejected prior to the ink containing the coloring material when the carriage 2 is moved in either of a forward direction shown by an array A1 and a backward direction shown by an array A2.

The print head 3 has a nozzle array 31 used for ejecting black ink, not shown and three nozzle arrays 32, 33, and 34 used for ejecting each of the color ink. Also, the print head 3 has nozzle arrays 35 and 36 ejecting the processing liquid. These nozzle arrays are configured so that ejection ports in 1280 nozzles each are arranged. In the description of this specification, a nozzle is referred to as a portion provided with a ejection port ejecting a liquid (ink, processing liquid) supplied into the print head, a liquid passage communicating with this ejection port, and a ejection energy generating unit (heater, for example) provided in the liquid passages. This nozzle is also referred to as a printing element. Hereinafter, driving the print element (heater) is simply referred to as driving nozzle.

The carriage 2 is movably guided by a guide shaft 8 mounted on a frame 7 in the array A direction, that is, in a main scanning direction. Also, the carriage 2 is connected to a driving belt 6 included in a transmission mechanism 5 transmitting a driving force of a CR motor M1. Therefore, by rotating the CR motor M1 forward or backward, the carriage 2 is reciprocally moved along the guide shaft 8. Moreover, in the frame 7, a scale (encoder) 9 indicating an absolute position of the carriage 2 in the main scanning direction is arranged in parallel with the guide shaft 8.

On a back portion of the frame 7, a sheet convey mechanism 10 is arranged. A print medium P in various sizes such as A4-size sheet or postcard size sheet can be loaded plurally on a sheet convey tray 11 included in the sheet convey mechanism 10. The sheet convey mechanism 10 is provided with a separation roller, not shown, driven by an LF motor M2 (omitted in FIG. 1). By this separation roller, the print medium P is fed from the sheet convey tray 11. The fed print medium is then, fed by a conveying mechanism such as a conveying roller to a printing position opposite to a print head 3 mounted on the carriage 2.

Moreover, the inkjet printing apparatus 1 is provided with a recovery device 15 including a capping unit 13, a wiping unit 14 and the like. In non-printing time of the inkjet printing apparatus 1, the print head 3 is capped by the capping unit 13, and a recovery operation such as suction and recovery processing is performed. Also, ink adhering to the print head 3 is removed by the wiping unit 14.

An ink receiving container containing preliminary ejection ink (hereinafter referred to as a preliminary ejection box) is arranged between the capping unit 13 and an image printable region (omitted in FIG. 1). After the carriage has been moved to a predetermined position, eject recovery processing can be performed by preliminary ejection with respect to the preliminary ejection box.

At the time of printing, the carriage 2 is moved in the forward direction of the array A (moving direction from a home position side to the other end, for example), and along with the movement, ink droplets are ejected from each of the nozzles of the print head toward the print medium P according to image data. The movement of the print head with the carriage and eject of the ink droplets for printing is also referred to as printing scanning. If the carriage 2 has moved to the other end of the print medium P, the separation roller is rotated only by a predetermined amount so as to convey the print medium P in the array B direction (sub-scanning direction, conveying direction) by a predetermined amount. Then, while the carriage 2 is moved in the backward direction of the array A2 (moving direction from the other end to the home position side, for example), printing is performed. In this way, by repeating the printing scanning of the carriage and the conveying operation of the print medium, an image is printed on the whole print medium. A printing method in which printing is performed by ejection of ink droplets in movement of the print head 3 in either of forward and backward directions is referred to as bidirectional printing method.

The print head 3 is provided with an electrothermal conversion element (hereinafter referred to as a heater) converting electric energy to thermal energy. The ink is film-boiled by the thermal energy generated by this heater, and ink is ejected through making use of pressure changes caused by garrayth and contraction of air bubbles by the film boiling. The heater (printing element) is provided at each of the ejection ports (also referred to as nozzles) constituting each of the nozzle arrays 31 to 36 so as to constitute a printing element array, and a driving pulse voltage is applied to each heater in order to eject the ink.

Figure 3:
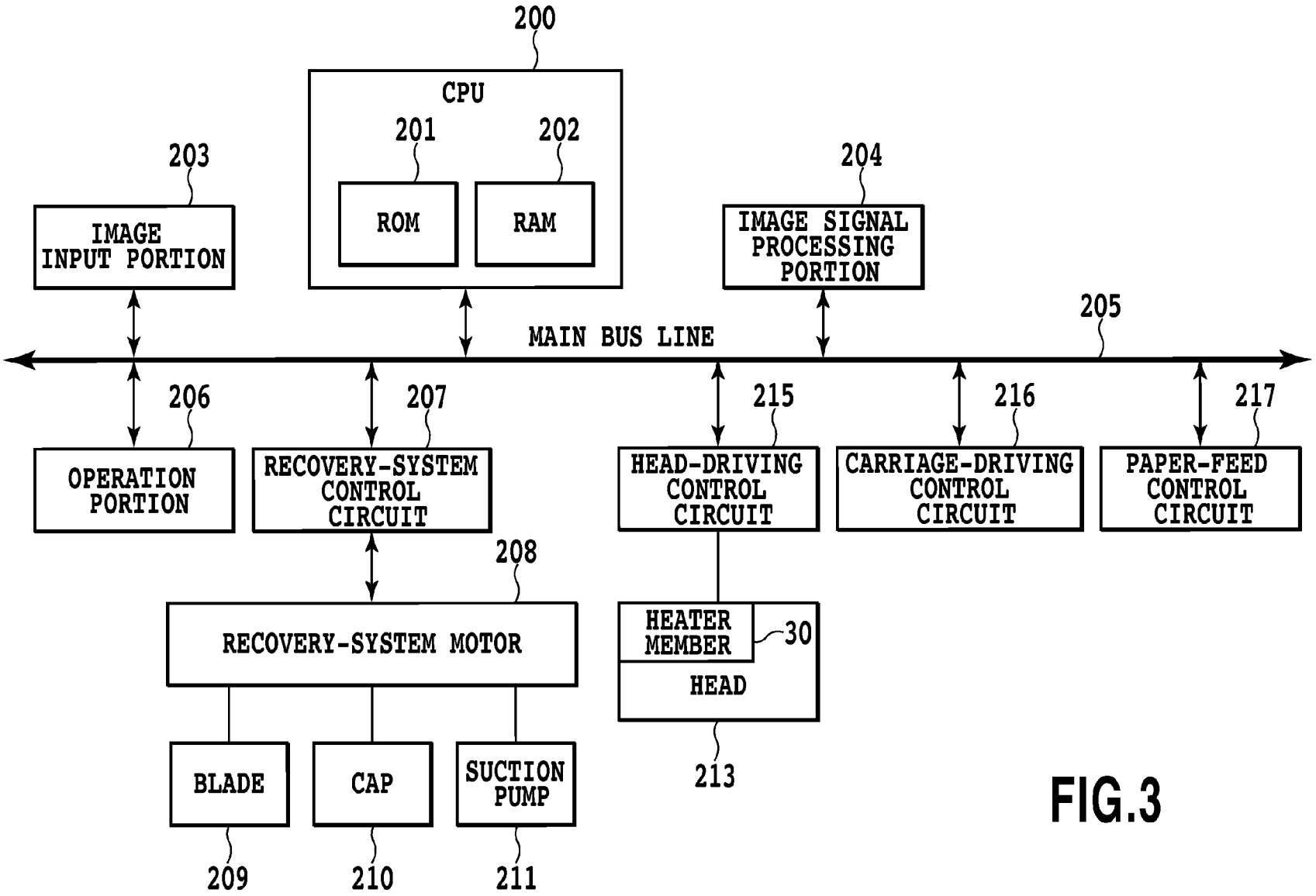
FIG. 3 is a block diagram illustrating a configuration of a control system of the inkjet printing apparatus shown in FIG. 1.

FIG. 3 is a block diagram illustrating a configuration of a control system of the inkjet printing apparatus according to an embodiment of the present invention.

The inkjet printing apparatus of this embodiment is connected to a host computer (personal computer or the like) so that printing is performed according to image data including image information and printing information prepared by using an application or the like of the host computer. In the figure, reference numeral 200 denotes a CPU as a controller controlling the entire inkjet printing apparatus. The CPU 200 is provided with a ROM 201 and a random access memory (RAM) 202. The CPU 200 controls the printing apparatus by sending a driving command to each driving portion through a main bus line 205. To the main bus line 205, an image input portion 203 and an image signal processing portion 204 are connected, and image information (image data) from the host computer is inputted to the image input portion 203 once and converted at the image signal processing portion 204 to an image signal (printing data) suitable for printing. Moreover, an operation portion 206 in which an operator performs various settings related to printing or the like and a recovery-system control circuit 207 connected to a recovery device of the print head 3 are connected to the main bus line 205. Furthermore, a head-driving control circuit 215, a carriage-driving control circuit 216, and a paper-convey (conveying) control circuit 217, which are driving portions, are connected to the main bus line 205, respectively. Also, in the RAM 202, a program for driving each driving portion is stored in advance and starts the program of each driving circuit according to the driving command from the CPU 200.

The printing apparatus is connected to the host computer through an interface connected to the main bus line 205. In the above explanation, the host computer and the printing apparatus are connected to each other in the configuration, but the device can be connected to external devices such as a digital camera, a flash memory and the like other than the host computer. At this time, the printing apparatus prints images taken by the digital camera or the like and images stored in the flash memory.

The recovery-system control circuit 207 is a circuit controlling the recovery device that keeps the ejection state of ink droplets from the print head favorable and controls driving of a recovery-system motor 208, a blade 209, a cap 210 and a suction pump 211. The recovery device comprises a blade 209 wiping off the ink droplets and dusts adhering to the ejection port surface and a cap 210 covering the ejection port surface during non-printing so that the ink does not evaporate from the ejection port. Moreover, the suction pump 211 is used for sucking the ink inside the print head by making the negative pressure inside the cap and forcedly ejecting thickened ink in the nozzle.

The head-driving control circuit 215 executes control of driving of the electrothermal converting element provided in a liquid passage communicating with an ejection port of the print head 213 according to the printing data, ink ejection for preliminary ejection or image printing, temperature adjustment of ink to be ejected and the print head and the like. Moreover, the carriage-driving control circuit 216 controlling driving of the carriage 2 and the paper-conveyance control circuit 217 controlling the sheet feed mechanism and the conveyance mechanism of the print medium drive a carriage motor and a conveying motor according to a program, respectively. A control unit controlling ejection conditions such as the driving order of the nozzles, which will be described later, a voltage to be applied to the electrothermal conversion element of the nozzle and/or a temperature of the nozzle array for ink eject for each print head independently is constituted by the head-driving control circuit 215 and the CPU 200.

Subsequently, a driving method of the electrothermal conversion element (heater) provided corresponding to each nozzle of the print head will be described. In the following description, driving of the electrothermal conversion element provided corresponding to each nozzle is also referred to as driving of a nozzle.

Figures 4A, 4B, 4C:
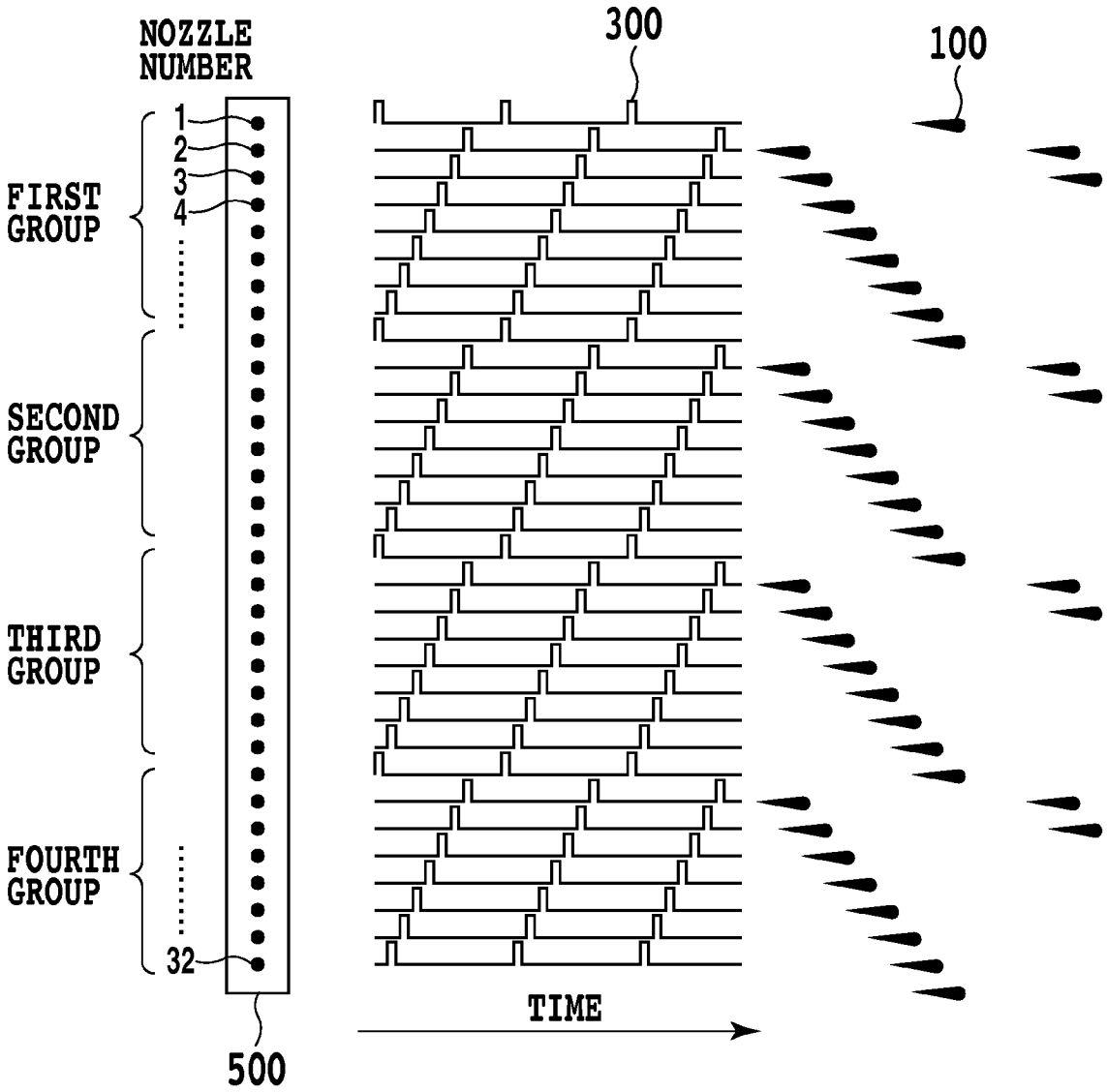
FIG. 4A is a schematic diagram illustrating arrangement of nozzles in a print head.
FIG. 4B is a diagram for explaining a basic driving method of the nozzles provided on the print head and diagram illustrating a driving signal in a time-division driving.
FIG. 4C is a diagram schematically illustrating ink droplets ejected from the print head by the driving method in FIG. 4B.

First, based on FIGS. 4A, 40, and 40, a basic driving method of the nozzle provided in the print head will be described. FIG. 4A shows a nozzle array of the print head, FIG. 4B shows a driving signal applied to the electrothermal conversion element provided in the liquid passage of the print head, and FIG. 4C schematically shows flying ink droplets ejected from each nozzle. Here, in order to explain the basic driving method of the nozzle, an example is shown in which the number of nozzles is configured to be smaller than the actual number of nozzles.

In FIG. 4A, a nozzle array 500 provided in the print head 3 is made up of 32 nozzles, for example. Each nozzle of the nozzle array 500 is given nozzle numbers 1 to 32 according to the arrangement order. Here, the nozzle number of the uppermost nozzle in the figure is given No. 1, and then, the nozzle numbers of 2, 3, . . . 32 are sequentially given to the nozzles located below. The nozzle array 500 is divided into four groups: a first group to a fourth group by 8 nozzles from the upper part in FIG. 4A. Moreover, each of the 8 nozzles in each group belongs to one of 8 driving blocks and sequentially driven in a time-division manner by the unit of driving block during printing. In the time-division driving, the nozzles in the same block are driven at the same time.

In the example shown in FIG. 4A, the four nozzles with the numbers given in the arrangement order of 1, 9, 17, and 25 are a first driving block (also simply referred to as a first block), and the four nozzles with the numbers 8, 16, 24, and 32 are a second driving block to each nozzle of the nozzle array 500. Similarly, the nozzles in each group are cyclically allocated to the driving blocks such that the nozzles with the numbers 2, 10, 18, and 26 are an eighth driving block and they are brought into a drivable state. In the case of time-division driving in which driving is performed sequentially from the first driving block to the eighth driving block in the ascending order, each of the heaters is sequentially driven by a pulse-state driving signal 300 shown in FIG. 4B, and an ink droplet 100 is ejected from each nozzle as shown in FIG. 4C corresponding to the driving signal. Hereinafter, the driving method for driving the nozzles provided in the print head in a time-division manner by the unit of driving block will be referred to as block driving.

Subsequently, a block configuration of the print head used in this embodiment and a driving signal to be applied will be described by using FIGS. 5 and 6.

Figure 5:
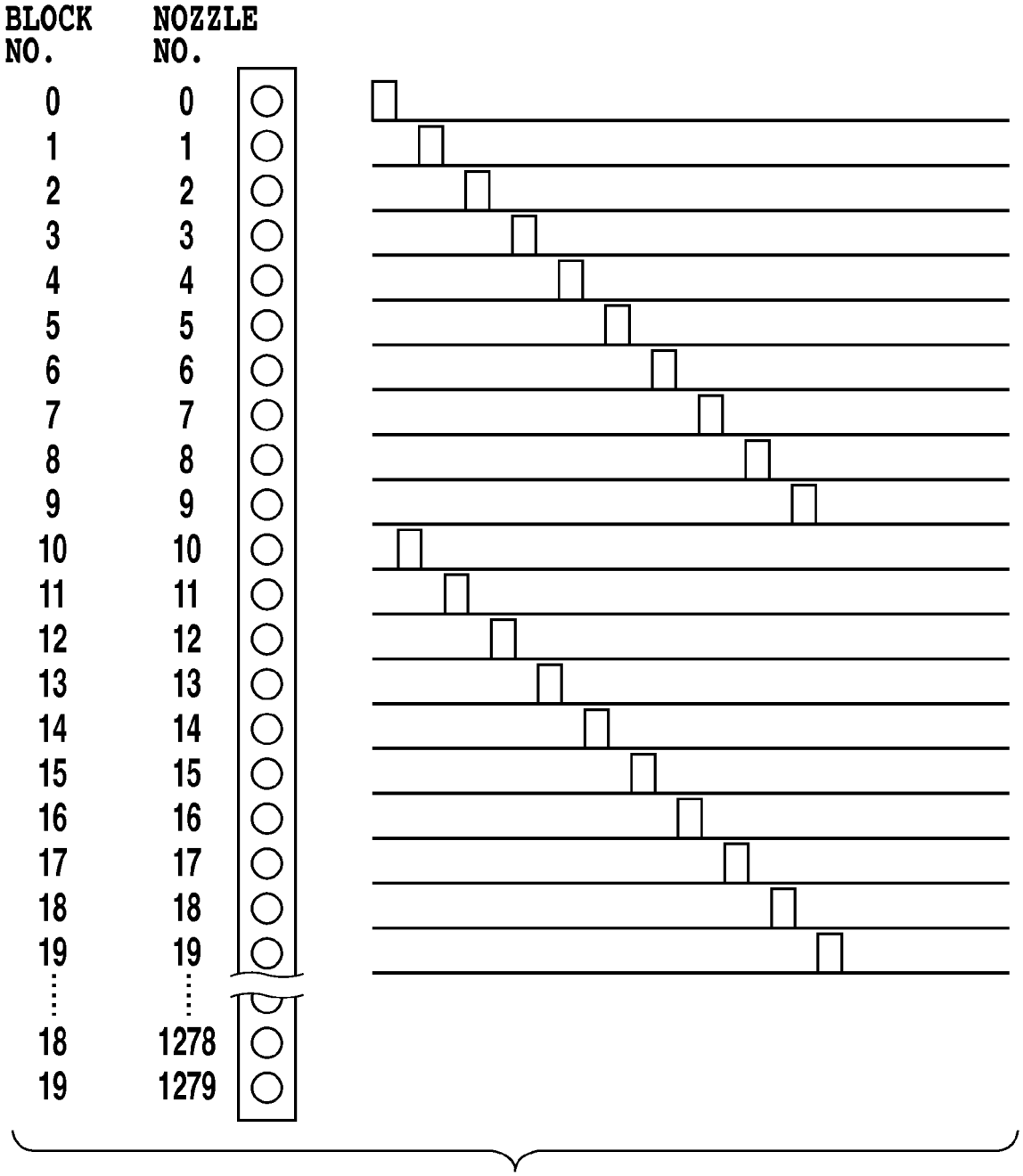
FIG. 5 is a schematic diagram illustrating a driving order of continuous time-division driving in the first embodiment.

In this embodiment, as shown in FIG. 5, the nozzle array in which 1280 nozzles are arranged is used, and one group is constituted by 20 nozzles. The nozzles with the numbers from 0 to 19 form the first group, the entire nozzle array is divided into 64 groups. Also, the number of blocks printed per unit time (number of time-divisions) is 20, the nozzles with the numbers 0, 20, 40, . . . have a block number 0, and 64 nozzles of the same block number are simultaneously driven so as to eject the ink droplets.

Figure 6:
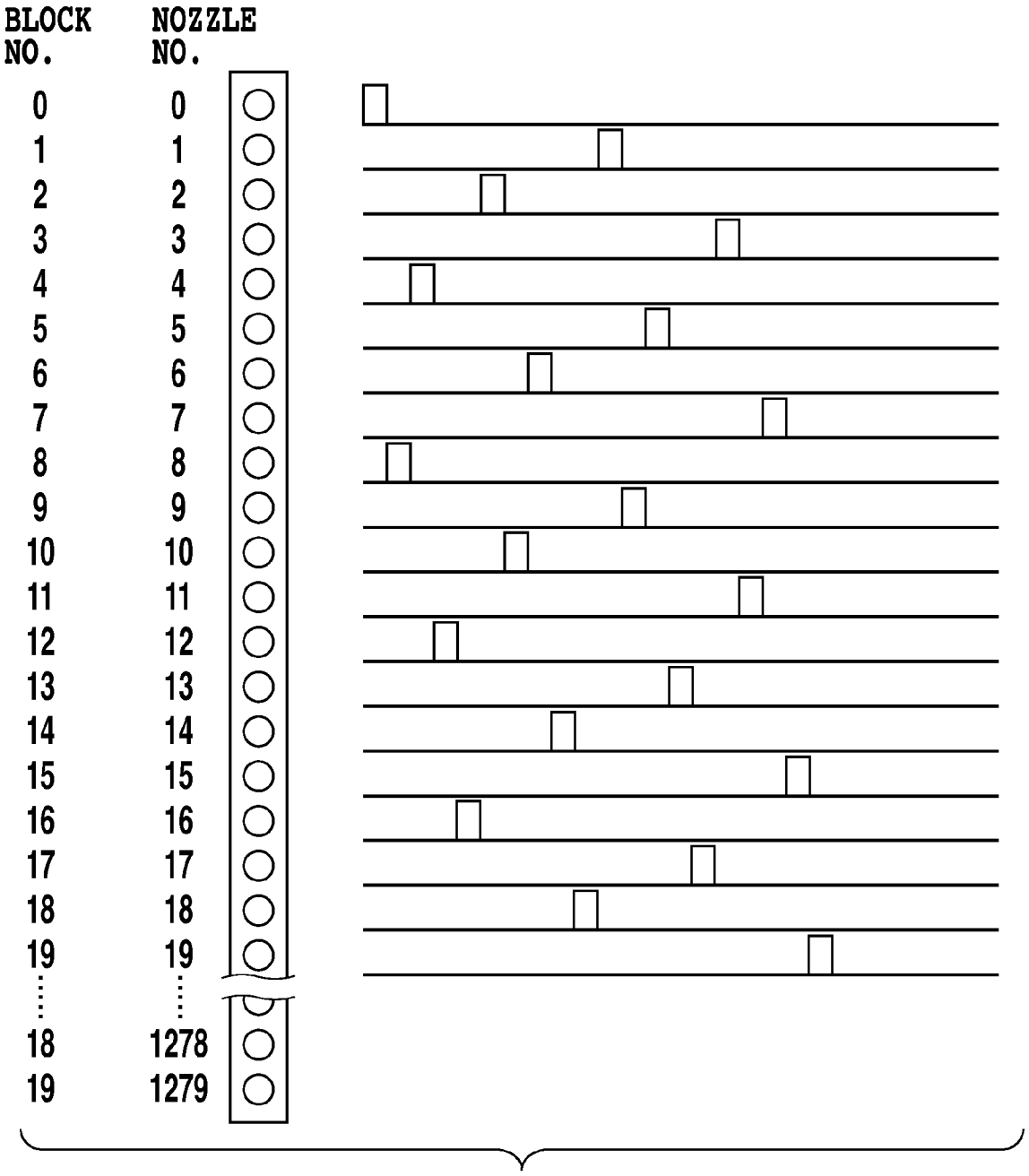
FIG. 6 is a schematic diagram illustrating a driving order of discrete time-division driving in the first embodiment.

In FIG. 6, too, the configurations of the groups and the blocks are the same. The 20 nozzles in 1 group are sequentially driven but they are all driven in 1 column. The print head shown in FIGS. 5 and 6 has the configuration of the nozzle array in which 1280 nozzles are arranged in one array. However, a print head in which two nozzle arrays made up of 640 nozzles (odd number array and even number array) are arranged with displacement in a nozzle arrangement direction by a distance of ½ of an arrangement pitch of the nozzles in each nozzle array may be used. At this time, the nozzles of the odd number array and the even number array are arranged with displacement in the main scanning direction. It can be so configured that one group (printing element group) is constituted by continuous 20 nozzles for each nozzle array of the odd number array and the even number array, and the nozzles of the same block number in each group are driven (block-driven) simultaneously for each nozzle array.

In the time-division driving shown in FIG. 5, driving is performed sequentially from the upper nozzle to the lower nozzle with a single empty driving timing. If the ink is ejected from all the nozzles, for example, driving is performed, first, for the nozzle with the block number 0, and the ink is ejected from the nozzle with the nozzle number 0. Subsequently, the ink is ejected sequentially from the nozzle with the block number 10, the nozzle with the block number 1, the nozzle with the block number 11, . . . the nozzle with the block number 20.

Figure 7:
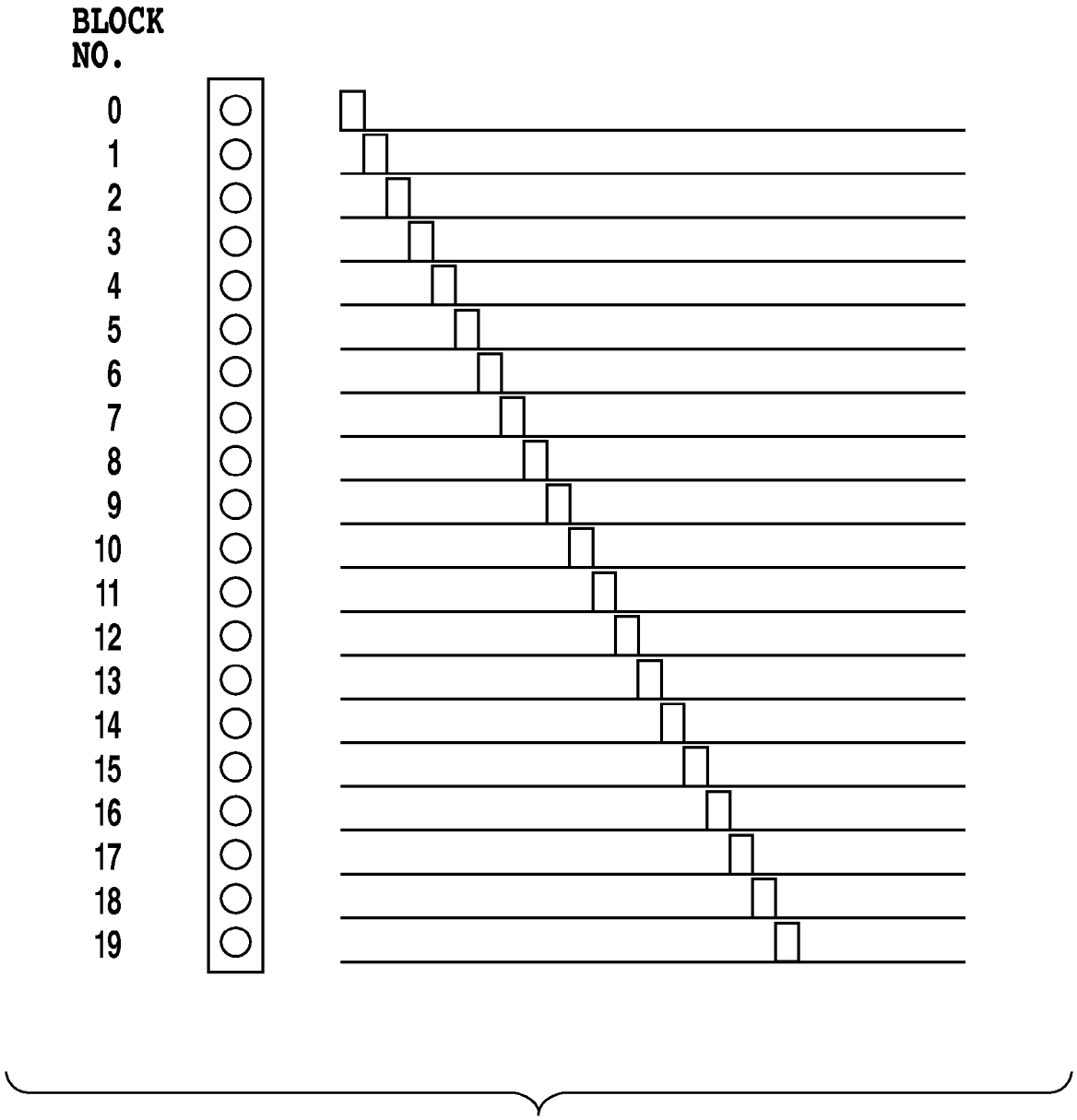
FIG. 7 is a schematic diagram illustrating a driving order of another continuous time-division driving in the first embodiment.

In the example shown in FIG. 5, when viewed from the single nozzle group as a whole, the adjacent nozzle in the nozzle arrangement position is not driven at a continuous driving timing. However, when a group of the No. 0 nozzle to No. 9 nozzle continuous in the nozzle arrangement (hereinafter referred to as a first division nozzle group) is viewed, the nozzles in the first division nozzle group (first division printing element group) are sequentially driven so as to eject the ink. The same applies to the group of the No. 10 nozzle to the No. 19 nozzle (hereinafter referred to as a second division nozzle group (second division printing element group)). And the ejecting from the nozzle (nozzle with the nozzle number 0) ejected for the first in the first division nozzle group is made prior to the eject from the nozzle (nozzle with the nozzle number 10) ejected for the first in the second division nozzle group. In this specification, this driving order, that is, the driving order of the nozzle numbers 0, 1, 3, . . . 9 in the first division nozzle group and the nozzle numbers 10, 11, 12, . . . 19 in the second division nozzle group is referred to as a "continuous" driving order. It is needless to say that continuous driving of the adjacent nozzles in one group related to the time division driving in order from the No. 0 nozzle to the No. 19 nozzle as shown in FIG. 7 is also included in the continuous driving order.

The driving order of the nozzles for which the division nozzle groups are set as described above is generalized as follows. Suppose that a set of the nozzles adjacent in the physical nozzle arrangement in the same number as the number of blocks of the time-division driving (time-division number d (an integer of 1 or more and n/2 or less): 20 in FIG. 5) constitutes one group. Then, consider that d pieces of the nozzles in the group are divided into n pieces (an integer of 1 or more; 2 in FIG. 5) of the division nozzle groups, and the time-division driving is performed. At this time, with regard to the "continuous" driving order, for d pieces of the nozzles continuous in the nozzle arrangement in the k-th division nozzle group (k is an integer of 1 or more and n/2 or less, and the first and second division nozzle groups in FIG. 5), the ink is ejected in order from these nozzles. The ejecting order of the nozzle ejected for the first in the k-th division nozzle group is prior to the ejecting order of the nozzle ejected for the first in the (k+1)-th division nozzle group.

According to the continuous driving order, the generation of ink mist can be suppressed, and the mist amount adhering to the ejection port surface can be reduced. Also, at that time, the ink ejection speed and the ejection amount are reduced. That is, it is known that when the ink is sequentially ejected from the adjacent nozzle, the ink eject from the adjacent nozzle is brought to an unstable state (crosstalk) since ink meniscus of the adjacent nozzle is vibrated at the ink eject. Then, the inventors of the present invention have found that if the ink is ejected in this unstable state, air currents generated by flying of the ink droplets can be suppressed by performing the time-division driving in the continuous driving order as described above. This is considered to be because the crosstalk diffuses energy of air bubbles caused by film boiling and lowers the speed of ink eject, by which a generated amount of air currents is reduced. Since the generated amount of air currents is reduced, a generated amount of ink mist is decreased, turbulence caused by interference of the air currents of the flying ink droplets is reduced, and as a result, an adhesion amount of the ink mist onto the ejection port surface is suppressed.

However, since the eject characteristics of the ink is relatively unstable, a landing position on the print medium of the ink droplets (main droplets), which contributes to printing may be displaced or the amount of ink droplets ejected from the ejection port may be fluctuated. Thus, in the embodiment of the present invention, the continuous time-division driving as described above is used for driving of a tranpreliminarynt processing liquid not containing a coloring material. As a result, an amount of ink mist of the processing liquid adhering to the ejection port surface can be reduced, and an ink amount fixing by reaction between the ink having a coloring material and the processing liquid can be reduced.

For example, since there is no influence of crosstalk in the nozzle ejecting for the first in each group of the time-division driving, the speed of ejected ink is fast and air currents are generated. The subsequent ink droplets ejected continuously are subjected to the influence of the crosstalk and the ejection speed is lowered, and though air currents are reduced, due to the influence of the air currents generated by the previously ejected ink droplets, the ink droplets located behind have deviated landing positions. In these continuously ejected ink droplets, the deviation of the landing position of the ink droplets located relatively behind is referred to as end deviation.

In an example shown in FIG. 5, if the number of ejects per unit time is large, the ink droplets of the No. 1 nozzle or the No. 11 nozzle are brought to the direction of the No. 0 nozzle and the No. 10 nozzle, respectively, being subjected to the influence of the air currents generated by continuous eject of the ink droplets. In this end deviation, since the landing position on a portion corresponding to one end of a band-shaped image printed by the continuously ejected ink droplets is displaced, a white stripe through which a ground color of the print medium is caused in the image. Since this white stripe is generated for each group in the continuous time-division driving of the print head, the white stripes occur often times with a narrow interval, that is, at a low pitch. Thus, the white stripe can be easily recognized, which leads to deterioration of image quality. This white stripe appears more remarkably when an image with a high printing rate is printed, or moreover, if the printing rate of a region to be printed in single printing scanning is high. That is, the white stripe appears more remarkably if the ink amount given per unit area is large or if the number of ejects per unit time is large.

On the other hand, in this embodiment, the driving order of the "discrete type" shown in FIG. 6 is used in driving with ink having a coloring material. As a result, an image having high quality and reliability without deviation of a landing position can be printed.

FIG. 6 shows an example of the driving order in the discrete time-division driving. In FIG. 6, the configurations of the groups and blocks are also the same as those shown in FIG. 5. In this specification, the driving of the nozzles performed in the driving order other than the above-mentioned continuous time-division driving is referred to as "discrete" driving. In the discrete driving shown in FIG. 6, a single group is not divided as shown in FIG. 5 but 20 nozzles in each group are driven in a time-division manner in an order different from their arrangement order so as to eject ink. In the discrete driving as shown in FIG. 6, if the ink is to be ejected from all the nozzles, first, the nozzle with the block number 0 is driven, and the ink is ejected. At this time, in the nozzle group consisting of the nozzles with the nozzle numbers 0 to 19, the ink is ejected from the nozzle with the nozzle number 0. Then, the ink is ejected sequentially from the nozzle with the nozzle number 8, the nozzle with the number 4, the nozzle with the number 12 . . . .

In the past, if the ink is to be ejected from the nozzle which is not adjacent by distributing the driving timing, it is known that the ink meniscus of the nozzle is not vibrated, and the ink is ejected in a stable state. That is, though an ink interface of the adjacent nozzle is vibrated when the ink is ejected from the nozzle, the ink is ejected from the separated nozzle with a stable ink interface in the subsequent eject operation, and it is considered that stable ink ejection is performed. It is also considered that the ink of the adjacent nozzle is ejected after the vibration of the ink interface caused by the ink ejection from the adjacent nozzle is finished. However, the inventors of the present invention have found that in the case of the ink ejection in this stable state, the generation of air currents caused by flying ink droplets is promoted. That is, in this discrete driving, since energy of the air bubbles generated by film boiling is accurately transmitted to the ejected ink, the speed of the ink eject is fast and the air current can be easily generated. As a result, not only the ink-mist generated amount is increased, but also the air currents of the flying ink droplets interfere with each other and cause disturbances, and the ink mist is made to adhere to the ejection port surface.

However, since the ink is ejected in a relatively stable state, there is little worry that the landing positions of the ink droplets (main droplets) to the print medium are deviated or the amount of the ink droplets (main droplets) ejected from the ejection port is fluctuated. For example, the influence of the air currents generated by the ink droplets ejected previously is limited to the adjacent nozzle region, and if the nozzle to perform the subsequent ejection is far away, the influence of the air currents generated by the previous eject hardly affects the ink droplets ejected from that nozzle. Therefore, in this embodiment, when the ink is to be ejected, particularly in order to print an image with a high printing rate, an image with higher quality can be printed with the discrete driving order since the end deviation can hardly occur.

As mentioned above, in this embodiment, the order of the block driving as shown in FIG. 8 is prepared plurally (driving order A, driving order B, driving order C), and these driving orders are selectively used for the ejection of a transparent processing liquid not containing a coloring material and the ejection of the ink containing the coloring material. That is, the continuous driving order is applied to the ejection of the processing liquid and the discrete driving order to the ink ejection, respectively. In FIG. 8, the driving order A is the continuous driving order shown in FIG. 5, and the driving order B is the discrete driving order shown in FIG. 6. As a result, application of the driving order A having a worry of the end deviation to the ejection of the ink containing coloring material can be avoided, but high-quality image printing can be achieved by applying the driving order B. The driving order C is the continuous driving order shown in FIG. 7.

On the other hand, though there is a worry of the end deviation, image will not be deteriorated by using the tranpreliminarynt processing liquid not containing a coloring material, and the driving order A or C with an emphasis on mist reduction is applied.

As mentioned above, the driving order in which image deterioration such as deviation hardly occurs and high-quality image printing is realized is used for the ink containing a coloring material, and the driving order in which the ink mist generation is suppressed is used for the tranpreliminarynt processing liquid not containing a coloring material. As a result, both the high-quality image printing and the improvement of device reliability and life can be realized.

Second Embodiment

In the above embodiment, the block driving order is optimized in order to reduce the mist of the tranpreliminary processing liquid not containing a coloring material, but mist can be reduced by other means.

In this second embodiment, a size of a driving voltage pulse applied to the heater of the print head 3 is controlled. That is, the driving voltage pulse to be applied to the heater of print head for ejecting the transparent processing liquid not containing a coloring material is made smaller than the driving voltage pulse to be applied to the heater of the print head for ejecting the ink containing the coloring material.

Figure 9:
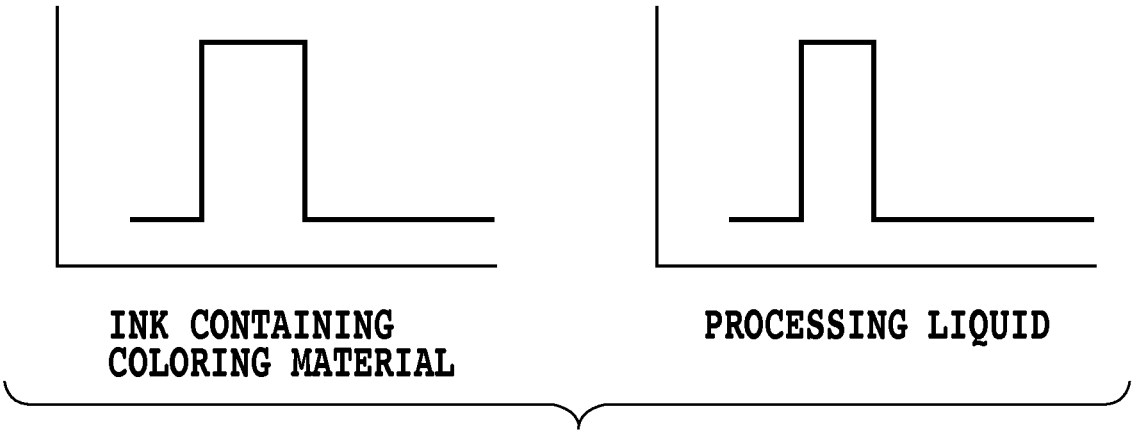
FIG. 9 is a schematic diagram illustrating a driving voltage pulse in a second embodiment.
Figure 10:
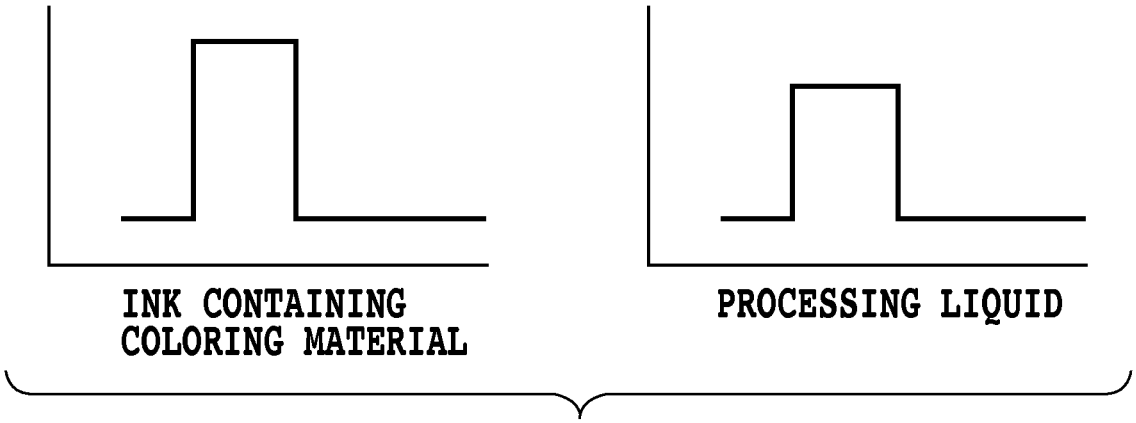
FIG. 10 is a schematic diagram illustrating the driving voltage pulse in the second embodiment.

As control of the size of the driving voltage pulse, a method in which a voltage value of the driving voltage pulse is made constant and a width of a driving pulse is controlled as shown in FIG. 9 can be employed. As shown in FIG. 10, a method in which a pulse width of the driving voltage pulse is made constant and the voltage value of the driving voltage pulse is controlled can be also employed. Moreover, both the pulse width of the driving voltage pulse and the driving voltage can be controlled. In any case, the size of the driving voltage pulse to be applied to the heater corresponding to each nozzle at the time of ejecting the processing liquid is made smaller than the size of the driving voltage pulse to be applied to the heater at the time of ejecting the ink containing a coloring material. As a result, an amount of thermal energy emitted by each heater (ejection energy of the ink) in a single eject operation is made smaller at ejecting of the processing liquid than at ejecting of the ink, and the mist amount, the ejection speed, and the ejection amount are suppressed. As a result, reaction between the ink containing the coloring material and the processing liquid on the ejection port surface of the print head to be fixed can be reduced. Also, although there remains a worry of image deterioration caused by deviation of the processing liquid ejected by reducing the driving voltage pulse, since the processing liquid does not contain a coloring material, image deterioration is not visually recognized as in the case of the deviation of the ink, and thus the image quality is not greatly deteriorated. With regard to the ink droplets, since the driving voltage pulse is not made small, the ejection speed or the ejection amount does not become insufficient and a desired landing state can be obtained.

As described above, in the ejection of the ink containing a coloring material, the driving voltage pulse with which image deterioration by deviation or the like hardly occurs and high quality image printing is performed is applied to the heater, while in the ejection of the transparent processing liquid not containing the coloring material, the size of the driving pulse is decreased and the generation of the ink mist is suppressed. As a result, both the printing of high quality images and the improvement of device reliability and life can be realized.

Third Embodiment

Subsequently, a third embodiment of the present invention will be described.

This third embodiment reduces a mist amount generated at the time of ejecting a processing liquid by changing temperature control at the print head between ink containing a coloring material and the transparent processing liquid not containing a coloring material.

In general, in an inkjet printing apparatus, it is known that eject characteristics of a liquid or particularly a diameter of an ejected droplet (main droplet) is changed according to a temperature of an ejected liquid such as ink and a processing liquid. In a printing apparatus ejecting ink by thermal energy, it is also known that the thermal energy given to the ink does not entirely become ejection energy but the thermal energy is accumulated in the print head with printing, and thus a temperature of the print head has a tendency to rise.

Figure 11:
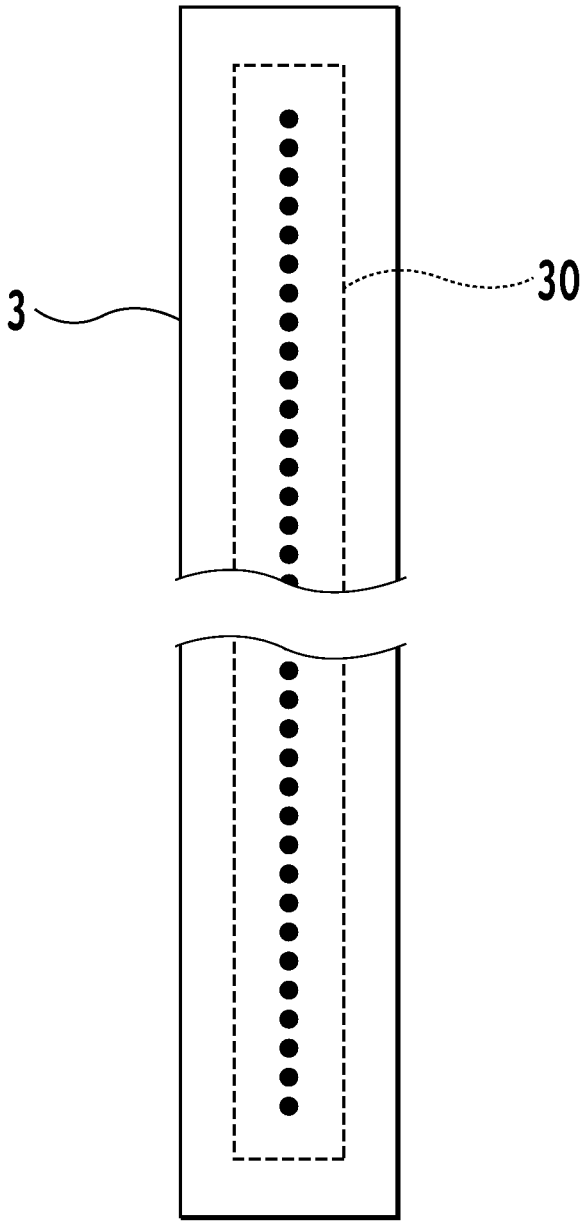
FIG. 11 is a schematic diagram illustrating a heater member provided on a print head in a third embodiment.

As mentioned above, since the temperature of the print head is changed with printing, an amount of ejected ink droplets is different and a diameter of the ink droplet landing on a print medium is changed, and printing density may be changed. Moreover, since physical characteristics such as viscosity or surface tension of ink are changed with a temperature, the ejection state from the nozzle is also changed depending on the change. For example, if a temperature of the print head is low, ink viscosity is high, and normal ejection is not performed at initial printing, and image formation may become defective. Therefore, in the inkjet printing apparatus, in order to ensure a favorable ejection state of ink containing a coloring material from the initial printing and to realize an appropriate image printing operation, temperature control of the print head is performed before the start of the printing operation. FIG. 11 shows an outline diagram of the vicinity of the nozzle. The temperature control is made by applying a voltage to a heater member 30 (See FIG. 11) and observing the temperature by a temperature sensor, not shown, every 10 ms so that a target temperature is reached. In this third embodiment, the heater member 30 provided around a nozzle array is used as a heating unit, and heat generation of the heater member is controlled so that the print head 3 ejecting ink is kept at 35 degrees. It is also possible to use a heater for ink ejection for temperature control of the print head 3 ejecting ink. In this case, in order to avoid wasteful ink ejection, it is preferable to heat the heater to a temperature at which the ink is not ejected. That is, a size of the above-mentioned driving pulse is controlled so that thermal energy smaller than that to be given at ink eject is generated.

On the other hand, while the print head 3 ejecting the ink containing a coloring material is temperature-controlled as described above, the print head 3 ejecting the transparent processing liquid not containing the coloring material is not temperature-controlled in the third embodiment. By not executing the temperature control of the transparent processing liquid not containing the coloring material, a mist amount, an ejection speed, and an ejection amount are reduced, and reaction between the ink containing the coloring material and the processing liquid on a head surface to be fixed can be prevented. By not executing the temperature control for the print head ejecting the processing liquid, although there is a worry that the ejected processing liquid is deviated, image deterioration is not visually recognized and does not cause a problem if the ejected processing liquid is transparent. Also, since the processing liquid does not contain a coloring material, viscosity change by temperature does not happen as much as in the case of ink, and ejection performance is not greatly changed even if the temperature control is not executed.

In this third embodiment, the temperature control of the print head ejecting the transparent processing liquid not containing the coloring material is not executed, but the minimum temperature control may be executed as necessary.

As mentioned above, in the ejection of the ink containing a coloring material, the head temperature control in which image deterioration such as deviation of the ink droplets, density variation and the like hardly occurs and high quality image printing is performed is executed, while in the ejection of the transparent processing liquid not containing the coloring material, the head temperature control in which ink mist generation is suppressed is execute. As a result, both the high quality image printing and the improvement of device reliability and life can be realized.

Other Embodiments

The present invention can be configured so that more excellent effects can be obtained by combining configurations of the above embodiments as appropriate. That is, any two of selection of the driving order in the block driving in the first embodiment, control of a size of a driving pulse in the second embodiment, and temperature control in the third embodiment or three of them can be combined. For example, the selection control of the driving order of the block driving in the first embodiment and the temperature control of the print head in the third embodiment can be executed together or the control of driving order of the block driving in the first embodiment and the control of the driving pulse size in the second embodiment can be executed together. It is needless to say that the temperature control in the third embodiment can be executed along with the control of the size of the driving pulse in the second embodiment.

Also, in the above embodiments, the mode in which the ink and the processing liquid coagulating or reacting with the coloring material in the ink are used has been explained, but the present invention is not limited to such a configuration. For example, the present invention can be applied to a mode in which ink with different printing density per droplet is used in the same color for printing, and it can be also applied to a mode in which these inks react (coagulate or insolubilization). In such modes, a ejection condition of ink with relatively low printing density (light ink) is made a condition in which mist is hardly generated (continuous division-driving method, for example), while a ejection condition of ink with relatively high printing density (dark ink) is made a condition in which a landing position is hardly displaced (discrete division-driving method, for example). That is, the same effects as the above embodiments can be obtained by performing printing under the condition in which mist hardly occurs with light ink relatively difficult to be recognized in the dark ink and the light ink.

Also, in the above embodiments, the case with a so-called serial inkjet printing apparatus has been explained as an example in which the print head is moved in a direction crossing the conveying direction of the print medium so as to perform a printing operation, but the invention of the present application can be also applied to a so-called full-line inkjet printing apparatus in which a print head with nozzles arranged in a range larger than a width of the print medium along a direction crossing the conveying direction of the print medium is used for printing. For example, the print head in the full-line inkjet printing apparatus can be division-driven in the same way as in the above first embodiment or a size of a driving pulse can be controlled in the same way as in the second embodiment. Also, the temperature control of the print head can be executed in the same way as in the third embodiment.

Moreover, in the present invention, the case in which a heater is used as the ejection energy generating unit generating ejection energy for ejecting ink or a processing liquid has been explained as an example, but an electro-mechanical conversion element such as a piezo can be used as the ejection energy generating unit. That is, if the electro-mechanical conversion element is also used, a mist amount of the processing liquid can be suppressed by using the control of the driving order, control of an applied voltage, temperature control of the print head and the like in each of the above embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-324129, filed Dec. 19, 2008, which is hereby incorporated by reference herein in its entirety.

What is claimed is:

1. A printing apparatus comprising:

a printing head for performing printing on a printing medium, said printing head including a plurality of first nozzles forming a first nozzle array in a predetermined direction that ejects ink containing a coloring material and a plurality of second nozzles forming a second nozzle array, in the predetermined direction, that ejects processing liquid for coagulating or insolubilizing a coloring material in the ink; and a driving unit that drives the nozzles for printing on the printing medium by ejecting the ink and the processing liquid while scanning the recording head and the printing medium relatively, the driving unit being configured to drive the plurality of first nozzles such that, for a group consisting of a number of the first nozzles, the number of the first nozzles belonging to the group are sequentially driven in a predetermined order to eject ink and configured to drive the plurality of second nozzles such that, for a group consisting of a number of the second nozzles, the number of the second nozzles belonging to the group are sequentially driven in a predetermined order to eject processing liquid, wherein the driving unit drives a predetermined first nozzle in the plurality of first nozzles at a K-th order and drives a predetermined second nozzle in the plurality of second nozzles at an L-th order, L being different from K, such that an order of ejection of the ink from the predetermined first nozzle in the group of the first nozzle array is different from an order of ejection of the processing liquid from the predetermined second nozzle in the group of the second nozzle array at a position corresponding to a position of the predetermined first nozzle in the predetermined direction.

2. The printing apparatus according to claim 1, wherein the driving unit sequentially drives discrete nozzles among the nozzles belonging to the group of the first nozzle array and sequentially drives adjacent nozzles among the nozzles belonging to the group of the second nozzle array.

3. The printing apparatus according to claim 1, wherein the processing liquid does not contain the coloring material.

4. The printing apparatus according to claim 1, wherein the driving unit drives the plurality of first nozzles and second nozzles such that an order of ejections of the ink from at least two first nozzles in the group of the first nozzle array are respectively different from an order of ejections of the processing liquid from at least two second nozzles in the group of the second nozzle array at positions respectively corresponding to positions of the at least two first nozzles in the predetermined direction.

5. The priming apparatus according to claim 1, wherein the driving unit sequentially drives the plurality of first nozzles such that ink ejection from a first nozzle is performed after vibration of the ink interface caused by ejection from another first nozzle adjacent to the first nozzle is finished, and sequentially drives the plurality of second nozzles such that ink ejection from a second nozzle is performed in the state where the ink interface is vibrating by ejection from another second nozzle adjacent to the second nozzle.

6. A printing method comprising the steps of:

performing printing on a printing medium using a printing head including a plurality of first nozzles forming a first nozzle array in a predetermined direction that ejects ink containing a coloring material and a plurality of second nozzles forming a second nozzle array, in the predetermined direction, that ejects processing liquid for coagulating or insolubilizing a coloring material in the ink; and driving the nozzles for printing on the printing medium by ejecting the ink and the processing liquid while scanning the recording head and the printing medium relatively and driving the plurality of first nozzles such that, for a group consisting of a number of the first nozzles, the number of the first nozzles belonging to the group are sequentially driven in a predetermined order to eject ink and driving the plurality of second nozzles such that, for a group consisting of a number of the second nozzles, the number of the second nozzles belonging to the group are sequentially driven in a predetermined order to eject processing liquid, wherein the driving step drives the predetermined first nozzle in the plurality of first nozzles at a K-th order and drives the predetermined second nozzle in the plurality of second nozzles at an L-th order, L being different from K, such that an order of ejection of the ink from a predetermined first nozzle in the group of the first nozzle array is different from an order of ejection of the processing liquid from a predetermined second nozzle in the group of the second nozzle array at a position corresponding to a position of the predetermined first nozzle in the predetermined direction.

7. The printing method according to claim 6, wherein the driving step sequentially drives discrete nozzles among the nozzles belonging to the group of the first nozzle array and sequentially drives adjacent nozzles among the nozzles belonging to the group of the second nozzle array.

8. The printing method according to claim 6, wherein the processing liquid does not contain the coloring material.

9. The printing method according to claim 6, wherein the driving step drives the plurality of first nozzles and second nozzles such that an order of ejections of the ink from at least two first nozzles in the group of the first nozzle array are respectively different from an order of ejections of the processing liquid from at least two second nozzles in the group of the second nozzle array at positions respectively corresponding to positions of the at least two first nozzles in the predetermined direction.

* * * * *